US006030272A

United States Patent [19]

Hu

[11] Patent Number: 6,030,272

[45] Date of Patent: Feb. 29, 2000

[54] TOYS HAVING GYROSCOPE-BASED MOTION RESISTING ACTION

[75] Inventor: Antonio C. Hu, Menlo Park, Calif.

[73] Assignee: S.R. Mickelberg Company, Inc., Jenkintown, Pa.

[21] Appl. No.: 09/183,998

[22] Filed: Nov. 2, 1998

[51] Int. Cl.[7] ..... A63H 33/30; A63H 33/26

[52] U.S. Cl. ..... 446/233; 446/473

[58] Field of Search ..... 446/233, 473

[56] References Cited

U.S. PATENT DOCUMENTS

| | | | |
|---|---|---|---|
| 796,893 | 8/1905 | Brennan | 446/233 X |
| 3,617,056 | 11/1971 | Herbold | 446/233 X |
| 4,017,083 | 4/1977 | Johnson | 446/233 X |
| 4,526,554 | 7/1985 | Goldfarb et al. | 446/429 |
| 4,678,450 | 7/1987 | Scolari et al. | 446/473 X |
| 5,113,745 | 5/1992 | Allen | 89/14.05 |
| 5,145,446 | 9/1992 | Kuo | 446/473 X |
| 5,273,607 | 12/1993 | O'Scanlon | 446/473 X |
| 5,326,303 | 7/1994 | D'Andrade | 446/473 X |

FOREIGN PATENT DOCUMENTS

| | | | |
|---|---|---|---|
| 959574 | 3/1950 | France | 446/233 |

*Primary Examiner*—John A. Ricci

*Attorney, Agent, or Firm*—Caesar, Rivise, Bernstein, Cohen & Pokotilow, Ltd.

[57] ABSTRACT

Toys, e.g., swords, guns, shields, to be held in the hand of a user and manipulated/moved. The interior of each of the toys includes a gyroscope, which when operated creates considerable rotational momentum, tending to resist the movement of the toy by the user. This action enhances the user's fun. The toys include a molded plastic housing having a hollow interior portion and a hand-grip portion arranged to be grasped in the hand of a user to lift the toy and manipulate it in various orientations. The gyroscope is mounted within the housing, e.g., in the handle portion. An electric motor is provided for rotating the gyroscope. The motor is powered by a power supply, e.g., a battery pack, located within the housing. A manual, on-off switch is provided in the toys for enabling the electric power from the batteries to energize the motor. Plural lamps are also provided for illuminating portions of the toy when the manual, on-off switch is closed.

12 Claims, 5 Drawing Sheets

34
50
58
52
52A
52C
60
62
60
52B
52C
54A
54
42
54A
54A
54A
56
60
60
62
58

TOYS HAVING GYROSCOPE-BASED MOTION RESISTING ACTION

BACKGROUND OF THE INVENTION

This invention relates generally to toys, and more particularly, to toys incorporating a gyroscope, so that when such toys are held in a user's hand and the user attempts to move the toy to a new orientation the operation of the gyroscope resists such a change, thereby providing an amusement effect.

Various gyroscope-based toys are commercially available, and some are the subject of United States Letters Patents. For example, U.S. Pat. No. 4,526,554 discloses a toy motorcycle which is powered by a fly wheel. The fly wheel acts as a gyroscope to maintain the motorcycle in an upright orientation while the motorcycle rolls across the ground.

The use of gyroscopes for stabilization of hand-held devices, is an old technique. For example, in U.S. Pat. No. 5,113,745 there is disclosed a stabilizing device for a rifle. The stabilizing device comprises a gyroscope and a resilient mounting assembly attached to the gyroscope to mount it on a rifle. The operation of the gyroscope enables the rifle to be aimed accurately, by preventing unwanted motion when the rifle is aimed.

While gyroscopes have been used for stabilization purposes, such as described above, they have not been used as a part of a toy or amusement device which is designed to be picked up and moved or oriented by the user to provide resistance to such movement, thereby providing a pleasing amusement effect. A need thus exists for such toys or amusement devices.

OBJECTS OF THE INVENTION

Accordingly it is a general object of this invention to fulfill that need.

It is another object of this invention to provide a toy utilizing a gyroscope which is simple in construction.

It is still a further object of this invention to provide a toy utilizing a gyroscope which is low in cost.

It is yet a further object of this invention to provide a toy including a gyroscope which can be shaped to simulate various hand-held devices, such as a sword, a shield, a gun, etc.

SUMMARY OF THE INVENTION

These and other objects of the invention are accomplished by providing a toy comprising a molded plastic housing having a hollow interior portion. The toy is arranged to be held in the hand of a user to enable the toy to be manipulated and oriented in various orientations to provide amusement value. The toy's housing includes a hand-grip portion arranged to be grasped in the hand of a user to lift the toy and manipulate it in various orientations, a gyroscope mounted on a portion of the housing, an electric motor connected to the gyroscope to cause the gyroscope to operate when the motor is energized, and a power supply for energizing the motor, whereupon the operation of the gyroscope tends to resist reorientation of the toy.

DESCRIPTION OF THE DRAWINGS

Other objects and many of the attendant advantages of this invention will become readily appreciated as the same becomes better understood by reference to the following detailed description, when considered in connection with the accompanying drawings, wherein.

DETAILED DESCRIPTION OF THE PREFERRED EMBODIMENT

Figure 1:
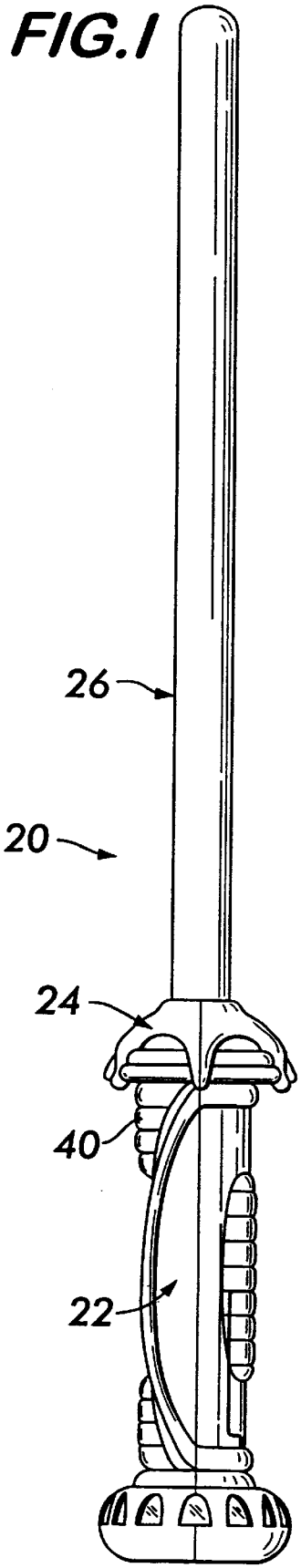
FIG. 1 is a side elevational view of one exemplary embodiment of toy constructed in accordance with this invention, in this case a toy simulating a futuristic sword.
Figure 7:
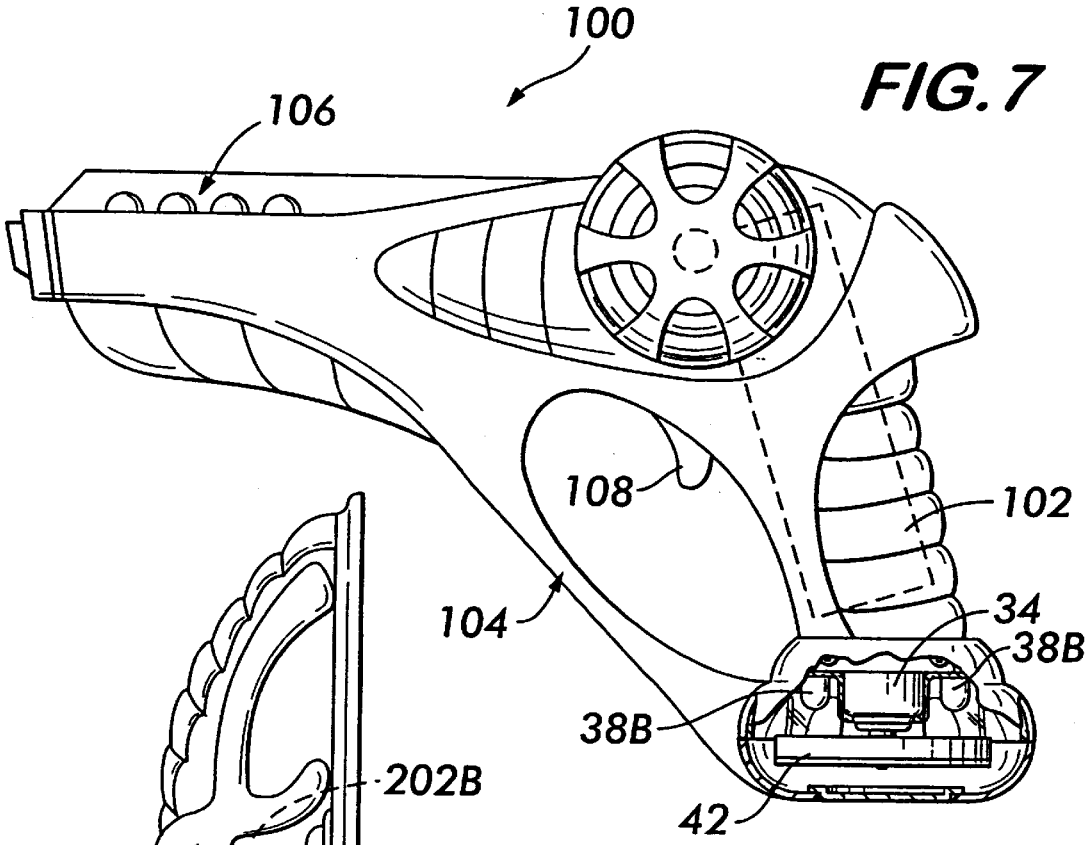
FIG. 7 is a side elevational view of another exemplary embodiment of toy constructed in accordance with this invention, in this case a toy simulating a futuristic gun.
Figure 8:
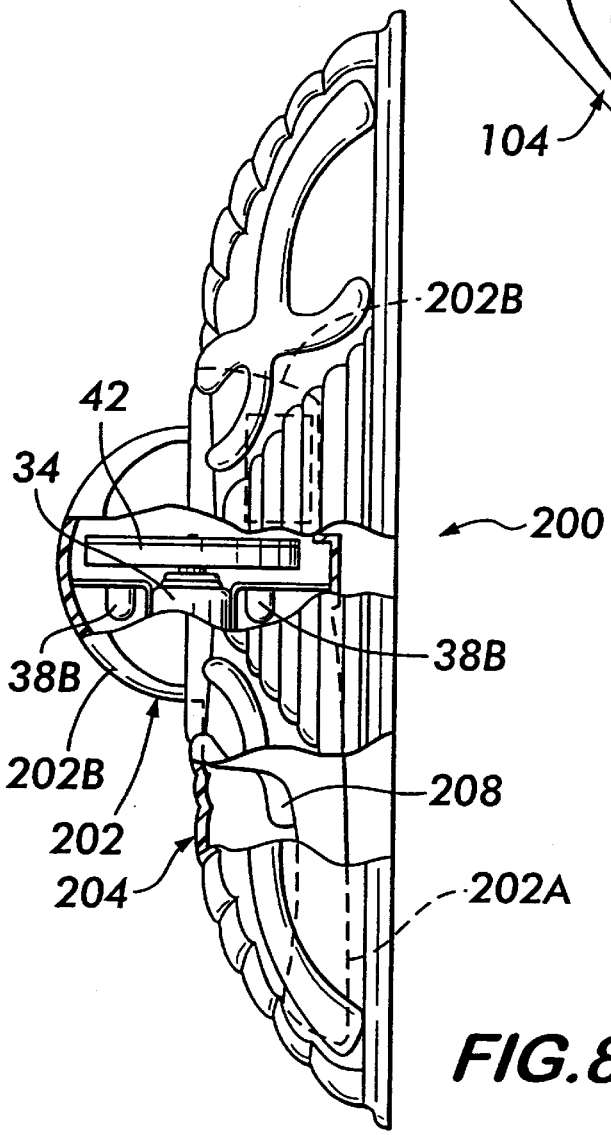
FIG. 8 is a side elevational view of yet another exemplary embodiment of toy constructed in accordance with this invention, in this case a toy simulating a futuristic shield.

Referring now to the drawing wherein like reference characters refer to like parts, there is 5 shown at 20 in FIG. 1 one exemplary embodiment of a toy constructed in accordance with this invention. The toy is in the form of a "futuristic" sword 20. In FIGS. 7 and 8 there are shown other exemplary embodiments of toys constructed in accordance with this invention, namely, a gun and a shield, respectively. It must be pointed out at this juncture that the embodiments of the toys shown herein are merely exemplary. Hence other types of toys arranged to be held in one's hand can be constructed in accordance with this invention. Moreover, while the toys shown herein have a "futuristic" appearance, it should be clear that such an appearance is also merely exemplary. Thus, the toys of this invention can be made to include any type or style of surface feature, color, shape, etc.

Figure 2:
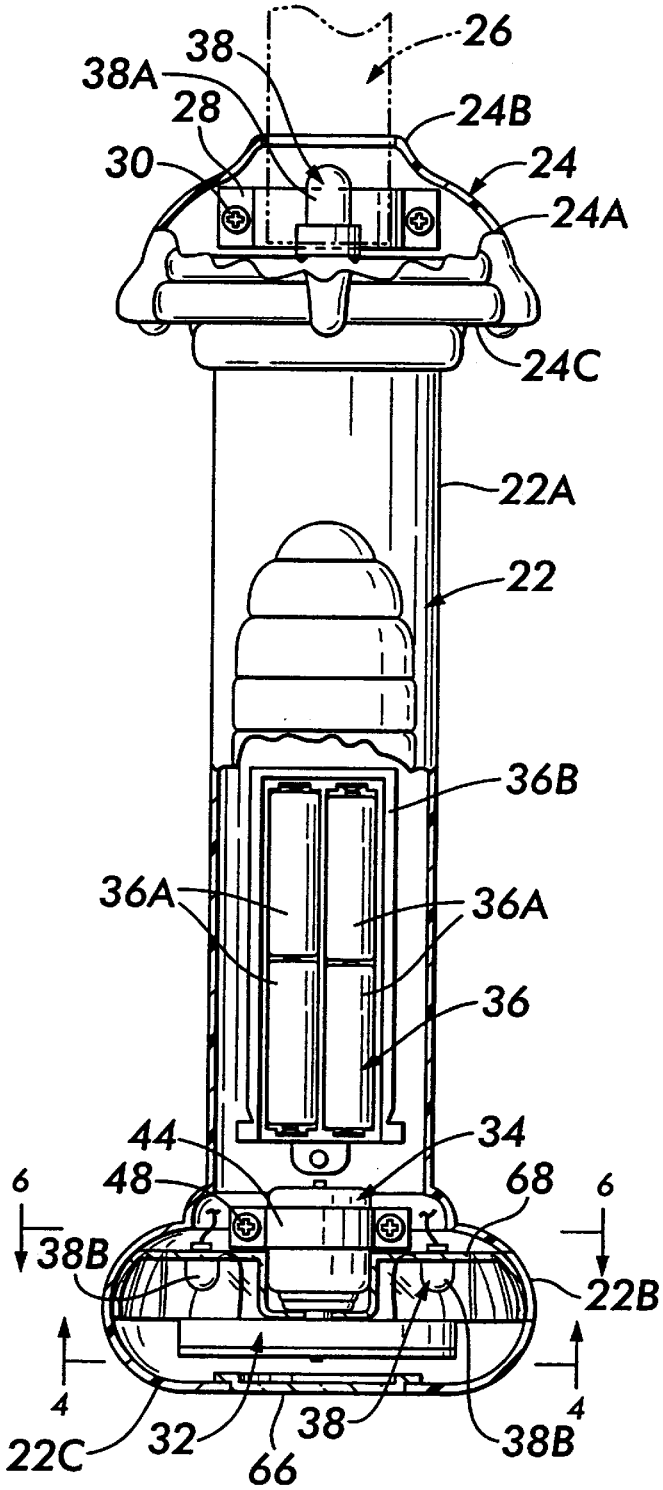
FIG. 2 is an enlarged front elevational view, partially broken away, of the handle portion of the sword shown in FIG. 1.

Referring to FIGS. 1 and 2 it can be seen that the sword 20 includes a handle or hand-grip portion 22, a hand-guard portion 24, and a blade portion 26. In accordance with a preferred embodiment of the invention the sword is in the form of a hollow shell, which is molded of any suitable material, such as plastic. The shell may comprise any number of components which are secured together to form the unit shown. The active components making up the sword, e.g., the gyroscope, etc., are located within the shell, as will be described later.

In the exemplary embodiment of the sword toy 20 shown the blade portion 26 is an elongate member, which is preferably hollow. The hand-guard portion 24 is also hollow and comprises a domed upper wall 24A having a central opening or hole 24B and an undercut generally planar bottom wall 24C. The undercut bottom wall 24C merges with the top end of the hand-grip portion 22. That portion basically comprises a cylindrical sidewall 22A and a bulbous lower sidewall 22B terminating in a generally planar bottom wall 22C.

It should be noted that while the blade portion 26 is preferably hollow, for reasons to be described later, it may be a solid member, if desired. In either case the blade portion 26 is an elongated member which is fixedly secured to the hand-guard portion by any suitable fastening means. In the embodiment shown the lower end of the blade 26 extends through a central opening 24B in the hand guard 24 and is secured in place via a half-round bracket 28 and associated screws 30. If, desired the blade can be welded or adhesively secured to the hand guard.

The active components of the toy basically comprise a gyroscope assembly 32, an electrical motor 34, a battery pack 36, illumination means 38, and an electrical on/off switch 40, all of which will be described in detail later, and are preferably located and mounted within the hollow interior of the shell within the hand guard and the hand-grip portions. The details and operation of the gyroscope assembly will be described later. Suffice it for now to state that the gyroscope assembly is in the form of a gyroscope wheel 42 (shown in detail in FIGS. 3 and 5) which is arranged to be rotated at a high rate of speed by the motor. The motor is operated by electrical energy from the battery pack, when the on/off switch is closed (i.e., in the on position).

As will be understood by those skilled in the art the momentum and rotation of a gyroscope wheel about its rotational axis tends to maintain the gyroscope in its established orientation against the action of external forces attempting to reorient the gyroscope. The toys of this invention make use of that effect to enhance their amusement or play-value. In this regard when the user, e.g., a child, of the sword attempts to move it through space to simulate the act of sword-play, the action of the spinning gyroscope wheel will tend to keep the sword in its orientation and hence resist such movement. This resistive action enhances the amusement effect or feel of use of the toy.

It must be pointed at this juncture that the gyroscope shown and described hereinafter, is exemplary of any number of "gyroscopic" devices which may be used as part of the subject invention. Thus, the term "gyroscope" as used herein is meant to include any shaped object which is arranged to be rotated at a high rate of speed about a fixed point and which includes portions extending outward from the axis of rotation in order to establish considerable rotational momentum. Preferably the gyroscope consists of an axially symmetrical rotating body or wheel, since that structure will rotate with minimum vibration. If, however, some vibratory action is desired, the body forming the gyroscope may be asymmetrical in shape. In the embodiment of the gyroscope shown herein the gyroscope wheel 42 has a weighted rim or peripheral portion (to be described later) so that most of its mass is concentrated as far from its rotational axis as possible, thereby increasing the rotational momentum produced as the wheel is rotated.

Figure 6:
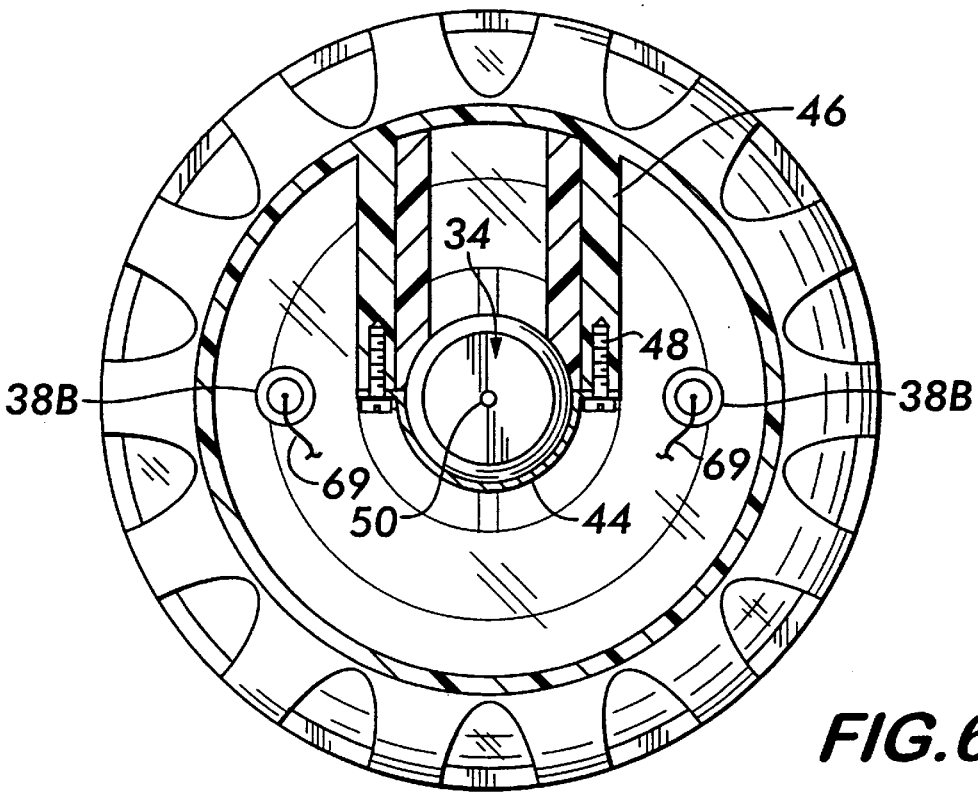
FIG. 6 is an enlarged sectional view taken along line 6—6 of FIG. 2.

The motor 34 serves to rotate the gyroscope wheel 42, when the motor is energized. The motor 34 is mounted within the bottom of the hand-grip portion of the sword by means of a half-round or semi-circular bracket 44 (FIGS. 2 and 6). The bracket is in turn mounted within the handle portion on the top of a pair of upright bosses 46 (FIG. 6), via respective screws 48 (FIG. 2 and 6). In the embodiment shown herein the motor is any conventional small electrical motor. The motor includes a rotary output shaft 50 (FIG. 3) which rotates at a very high rate of speed when the motor is energized. The gyroscope wheel 42 is mounted on the rotary shaft 50, so that shaft forms the axis of rotation of the gyroscope wheel.

Figure 3:
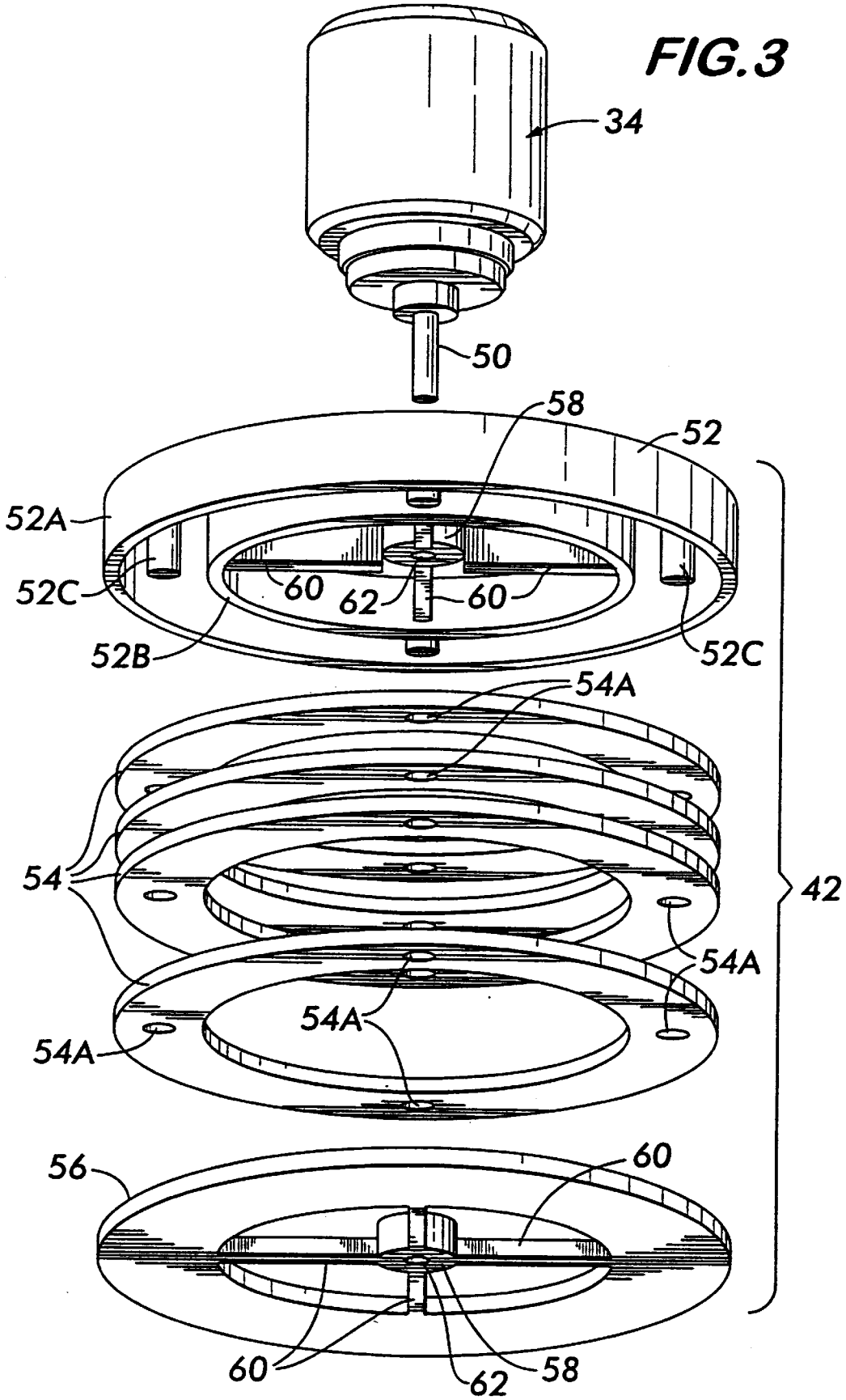
FIG. 3 is an enlarged exploded isometric view of the gyroscope assembly forming a portion of the toys of the subject invention.
Figure 4:
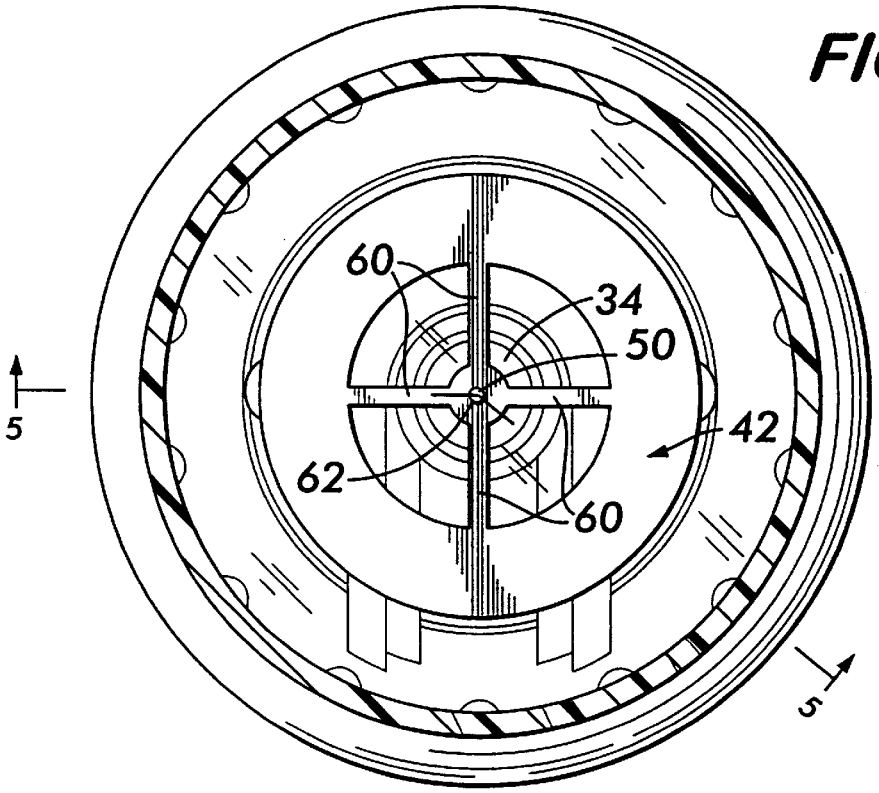
FIG. 4 is an enlarged sectional view taken along line 4—4 of FIG. 2.
Figure 5:
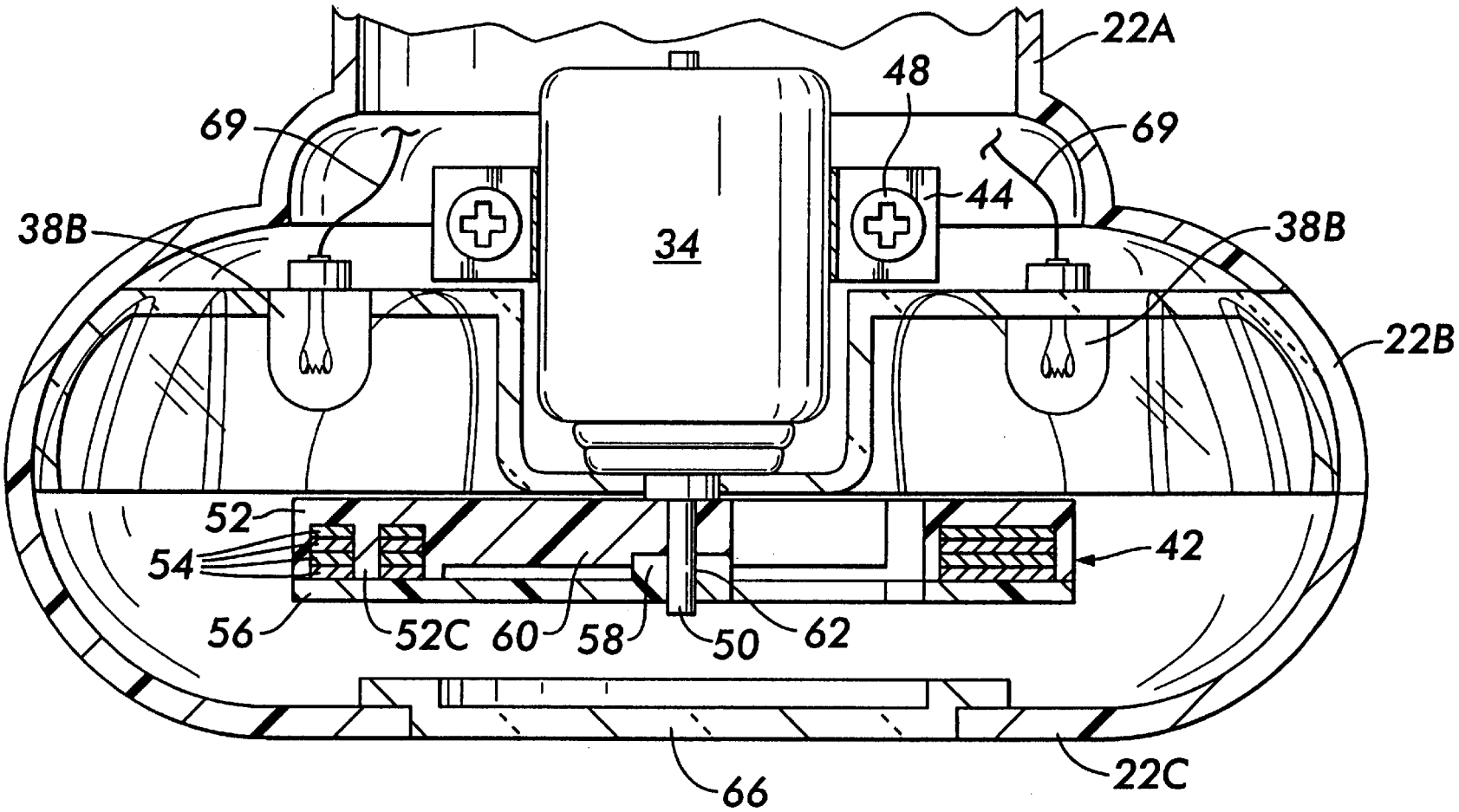
FIG. 5 is an enlarged sectional view taken along line 5—5 of FIG. 4.

As best seen in FIGS. 3 and 5 the gyroscope wheel 42 is a multi-component unit. In particular it includes a base portion 52, plural weighted annular rings 54, and a cover 56. The base portion is a planar member of annular circular profile having an upright peripheral exterior flange or rim 52A and an upright peripheral interior flange or rim 52B. The weighted annular rings 54 are each generally planar members, formed of the heavy material, e.g., iron. The outside diameter of each of the rings is slightly less than the inside diameter of the rim 52A, and the inside diameter of each of the rings is slightly less than the outside diameter of the rim 52B. The rings are arranged to be stacked on top of one another on the base portion and within the confines of the annular rims 52A and 52B. Each of the rings 54 includes four holes 54A therein. The holes are located equidistantly from one another. The rings are stacked one on top of the other so that their holes are aligned. Respective bosses 52C project upward from the base member 53 and extend through the aligned holes to hold the rings in position with respect to one another and securely on the base portion.

The central portion of the base member 52 includes a central hub 58 from which four spokes 60 project outward radially and merge with the interior rim 52B. The hub includes a central hole or aperture 62. The aperture 62 is arranged to tightly receive the free end of the motor's rotary output shaft 50 therein to mount the gyroscope wheel 42 on the motor.

The cover 56 is a generally planar annular member of circular profile having the same outside diameter as the outside diameter of the rim 52A of the base portion of the gyroscope wheel. The cover 56 also includes central hub 58 from which four spokes 60 project outward radially and merge with the inner edge of the annular portion of the cover. The hub 58, like the hub of the base portion 52, includes a central hole or aperture 62 which is arranged to tightly receive the free end of the motor's rotary output shaft 50.

The cover 56 is arranged to be disposed over the base portion 52 with the rings 54 seated therein as described above and then the cover is secured in place by any suitable means (not shown), e.g., an adhesive, a weld joint, etc., to complete the assembly of the gyroscope wheel 42.

The gyroscope wheel 42 is mounted on the rotary output shaft 50 of the motor by extending its free end through the aligned central openings 62 in the wheel. Since the diameter of the aligned central openings 62 is slightly smaller than the diameter of the rotary output shaft 50 the gyroscope wheel is frictionally held thereon. Additional means for securing the wheel to the shaft may be provided, if desired.

The motor 34 is operated from electric power provided internally by the battery pack 36. The battery pack 36 consists of four, conventional AA batteries 36A held within a hollow rectangular shaped case 36B. The case includes a rectangular lid (not shown) which is arranged to be fixedly secured to the case, via screws (not shown), to hold the batteries 36A in place. The battery pack 36 is mounted within the handle portion of the toy immediately above the motor 34 as shown in FIG. 2. The output shaft 50 of the motor extends downward within the handle portion so that the gyroscope wheel 42 faces or confronts the bottom wall 22C of the hand grip portion 22. The bottom wall 22C preferably includes an opening in which a transparent window 66 is mounted so that the gyroscope wheel is visible through the window.

The motor 34 is electrically connected to the batteries of the battery pack 36 via plural conductors (not shown). These conductors, as well as other conductors, the batteries 36A, the motor 34, the illumination means 38, and the on/off switch 40 make up the electrical circuitry of the toy. The on/off switch 40 is in the form of a button or lever which extends partly out through the toy's hand grip portion (see FIG. 1) so that it can be engaged by the index finger of the user's hand in which the hand-grip portion of the toy is held. This enables the user to press the on/off switch whenever desired. When the user presses the switch 40 electric power is provided from the battery pack 36 to the motor 34, thereby causing the motor to operate, whereupon the gyroscope wheel 42 is rotated about the longitudinal axis of the motor's output shaft at a high rate of speed. Since the gyroscope wheel is weighted, as described above, its high speed rotation creates considerable rotational momentum, thereby producing a substantial force tending to resist motion of the sword through space. This action enables the user to have considerably more fun when using the sword of this invention than he/she would by using a conventional toy sword which does not provide any resistance to movement.

In accordance with one preferred aspect of this invention, as mentioned above, the toy sword also includes the heretofore identified illumination means 38. These means are provided for illuminating portions of the toy when it is used. The illumination means basically comprises a first light bulb or lamp 38A which is located within the hand-guard portion domed wall 24A immediately below the lower end of the sword blade as shown in FIG. 2. The lamp 38A includes a pair of conductors (not shown) which form a portion of the electrical circuit. Accordingly, when the manual on-off switch is depressed and the gyroscope starts to spin the lamp 38A illuminates. The light produced by the lamp 38A passes up through the hollow interior of the sword blade 26, thereby causing the blade to "glow." If the blade portion of the sword is constructed so that it is not hollow, i.e., is a solid member, then it is preferable that the material making up the blade portion be transparent so that the light produced by the lamp 38A will be propagated up the length of the solid blade portion to cause it to glow.

The illumination means 38 also includes a second pair of lamps or bulbs 38B, which are mounted on a bracket 68 immediately behind the gyroscope wheel 42 within the hand-grip portion of the sword. The lamps 38B are disposed opposite in the hollow interior portion of the gyroscope wheel, i.e., the open-spoked portion of the wheel, so that when the lamps are illuminated the light which they produce passes through the open center portion of the gyroscope wheel and out the transparent window 66 at the bottom of the hand-grip portion 22. The pair of lamps are connected, via respective electrical conductors 69 to the electrical circuit. Accordingly, when the manual on-off switch is depressed the lamps 38B illuminate, whereupon the light passes through the central hollow portion of the rotating gyroscope wheel and out through the transparent window.

As can be seen in FIGS. 1 and 2 the outer surface of the toy sword 20 includes various surface features, e.g., indentations, to give the sword a "futuristic" appearance. These surface features are provided for aesthetic reasons. Thus, it must be appreciated that other surface appearance features can be provided, if desired. Moreover, all or portions of the toy sword may be colored or painted in the interest of aesthetics.

If desired, sound producing means (not shown) can be provided within the interior of the toy. Such sound producing means can be arranged, when actuated, either by electrical means (such as the battery pack) or mechanical means, to produce various types of sound. For example, the sound producing means may comprise an electrically operated buzzer, siren, synthesized voice, etc.

In FIG. 7 there is shown an alternative embodiment of the toy of this invention. In the embodiment shown in that figure toy is in the form of a "futuristic" gun 100. The gun includes a handle or hand-grip portion 102, a hand-guard portion 104, and a barrel portion 106. Like the sword 20, the gun 100 in the form of a hollow shell, which is molded of any suitable material, such as plastic, and may be fabricated of any number of components secured together to form the unit shown. The gun includes the same operative components, e.g., the gyroscope, the motor, the manual on-off switch, etc. as described heretofore. Those components, e.g., the motor 34, gyroscope wheel 42, lamps 38B, etc., are located within the handle portion 102. The lower end of the handle portion 102 is constructed like the sword, so that it includes a transparent window 66 through which the rotating gyroscope wheel may be seen, and through which light produced by the lamps 38B may pass. The lamp 38A may be located within the barrel portion 102 of the gun 100 to illuminate it.

In the gun embodiment the on/off switch is in the form of a trigger 108 which is mounted on the front of the hand-grip portion adjacent the point at which the handle portion 102 merges with the hand-guard portion 104. The trigger is connected in the electrical circuit in the same manner as switch 40 described heretofore so that upon "pulling" of the trigger electrical energy is provided from the battery pack to the motor and the illumination means.

In FIG. 8 there shown yet another alternative embodiment of the toy of this invention. In that embodiment the toy in the form of a futuristic "shield" 200. The shield 200 basically comprises a hand grip portion 202 and a guard panel portion 204. The hand grip portion 202 is a hollow member or shell formed of any desired number of members which are secured together and includes a lower section 202A and an upper section 202B. The lower section 202A is shaped like the hand-grip of a gun and is arranged to be grasped in the hand of the user. The upper section 202B is mounted on top of the lower section and includes a domed outer wall which projects generally perpendicularly to the longitudinal axis of the lower section 202A. The operative components of the shield are the same as those described with reference to the sword 20 and gun 100, and are mounted within the interior of the upper section 202B. The on/off button for the toy 200 is in the form of a trigger 208 mounted on the lower section 202A adjacent its merger point with the upper section 202B. The guard panel portion 204 is of generally circular profile and slightly convex shape. The guard panel 204 includes a central opening through which the domed projecting wall of the upper section 202B of the hand grip portion projects. The guard panel is secured to the hand grip portion to form an integral unit. The shield 200 includes the same operative components, e.g., the gyroscope, the motor, the manual on-off switch, etc. as described heretofore. Those components are located within the upper section 202B of the handle portion 202. The domed wall is preferably transparent (or may include a transparent window) through which the rotating gyroscope wheel 42 may be seen, and through which light produced by the lamps 38B may pass.

Without further elaboration, the foregoing will so fully illustrate my invention that others may, by applying current or future knowledge, readily adapt the same for use under various conditions of service.

I claim:

1. A toy comprising a molded plastic housing having a hollow interior portion, said housing including a hand-grip portion arranged to be grasped in the hand of a user to lift the toy and manipulate it in various orientations, a gyroscope mounted on a portion of said housing, an electric motor connected to said gyroscope to cause the gyroscope to operate when said motor is energized, and a power supply connected to said motor for energizing said motor, whereupon the operation of said gyroscope tends to resist reorientation of the toy, said housing being shaped to give the appearance of a sword, said sword having a blade portion and a hand-grip portion.

2. The toy of claim 1 additionally comprising electrically operated illumination means to illuminate a portion of said toy.

3. The toy of claim 2 wherein said illumination means illuminates said blade portion of said toy.

4. The toy of claim 3 wherein said blade portion of said toy is light transmissive, and wherein said illumination means is located in a portion of said blade so that light produced by said illumination means illuminates substantially the entire length of said blade portion.

5. The toy of claim 1 wherein said gyroscope, said motor, and said power supply are located within said handgrip portion of said sword.

6. The toy of claim 5 wherein a portion of said housing forming said handgrip portion is transparent to enable viewing of the operation of said gyroscope.

7. A toy comprising a molded plastic housing having a hollow interior portion, said housing including a hand-grip portion arranged to be grasped in the hand of a user to lift the toy and manipulate it in various orientations, a gyroscope mounted on a portion of said housing, an electric motor connected to said gyroscope to cause the gyroscope to operate when said motor is energized, electrically operated illumination means to illuminate a portion of said toy, and a power supply connected to said motor for energizing said motor, whereupon the operation of said gyroscope tends to resist reorientation of the toy.

8. A toy comprising a molded plastic housing having a hollow interior portion, said housing including a hand-grip portion arranged to be grasped in the hand of a user to lift the toy and manipulate it in various orientations, a gyroscope mounted on a portion of said housing, an electric motor connected to said gyroscope to cause the gyroscope to operate when said motor is energized, and a power supply connected to said motor for energizing said motor, whereupon the operation of said gyroscope tends to resist reorientation of the toy, said housing is shaped to give the appearance of a shield, said shield having a hand-grip portion and a plate portion.

9. The toy of claim 8 wherein said gyroscope, said motor, and said power supply are located within said handgrip portion of said toy.

10. The toy of claim 9 wherein a portion of said housing forming said handgrip portion is transparent to enable viewing of the operation of said gyroscope.

11. A toy comprising a molded plastic housing having a hollow interior portion, said housing including a hand-grip portion arranged to be grasped in the hand of a user to lift the toy and manipulate it in various orientations, a gyroscope mounted on a portion of said housing, an electric motor connected to said gyroscope to cause the gyroscope to operate when said motor is energized, and a power supply connected to said motor for energizing said motor, whereupon the operation of said gyroscope tends to resist reorientation of the toy, said housing being shaped to give the appearance of a gun, said gun having a hand-grip portion and a barrel portion, said gyroscope, said motor, and said power supply being located within said handgrip portion of said toy.

12. The toy of claim 11 wherein a portion of said housing forming said handgrip portion is transparent to enable viewing of the operation of said gyroscope.

* * * * *